United States Patent [19]

Schranz et al.

[11] Patent Number: 4,865,940

[45] Date of Patent: Sep. 12, 1989

[54] PHOTOGRAPHIC RECORDING MATERIAL

[75] Inventors: Karl-Wilhelm Schranz, Odenthal-Hahnenberg; Günther Schenk, Cologne, both of Fed. Rep. of Germany

[73] Assignee: Agfa-Gevaert Aktiengesellschaft, Leverkusen, Fed. Rep. of Germany

[21] Appl. No.: 309,040

[22] Filed: Feb. 9, 1989

Related U.S. Application Data

[63] Continuation of Ser. No. 115,115, Nov. 2, 1987, abandoned.

[30] Foreign Application Priority Data

Nov. 12, 1986 [DE] Fed. Rep. of Germany ..... 3638638

[51] Int. Cl.[4] ..... G03C 1/08; G03C 7/26; G03C 1/30; G03C 1/02

[52] U.S. Cl. ..... 430/138; 430/545; 430/619; 430/621; 430/623; 430/627

[58] Field of Search ..... 430/138, 545, 619, 621, 430/623, 627

[56] References Cited

U.S. PATENT DOCUMENTS

| | | | |
|---|---|---|---|
| 2,698,794 | 4/1950 | Godowsky | 430/365 |
| 3,276,869 | 10/1966 | McCune, Jr. | 430/138 |
| 3,396,026 | 8/1968 | Taylor | 430/138 |
| 4,063,952 | 12/1977 | Himmelmann et al. | 430/423 |
| 4,430,415 | 2/1984 | Aono et al. | 430/351 |

*Primary Examiner*—Mukund J. Shah
*Attorney, Agent, or Firm*—Connolly & Hutz

[57] ABSTRACT

A color photographic recording material contains a dispersion of hardened particles of a complex coacervate (packet emulsion) in at least one layer of binder, which particles are hardened with a hardener corresponding to the following formula I

I wherein $R^1$ and $R^2$ are identical or different and each denotes an alkyl group with 1 to 8 carbon atoms or an aryl or aralkyl group optionally substituted with an alkyl group having 1 or 2 carbon atoms or with a halogen atom or $R^1$ and $R^2$ together denote the atoms required for completing a heterocyclic ring, e.g. a piperidine or morpholine ring, optionally substituted with an alkyl group having 1 or 2 carbon atoms or with a halogen atom, $R^3$ denotes a hydrogen atom or an alkyl group having 1 or 2 carbon atoms and n represents 0 or 2.

4 Claims, 1 Drawing Sheet

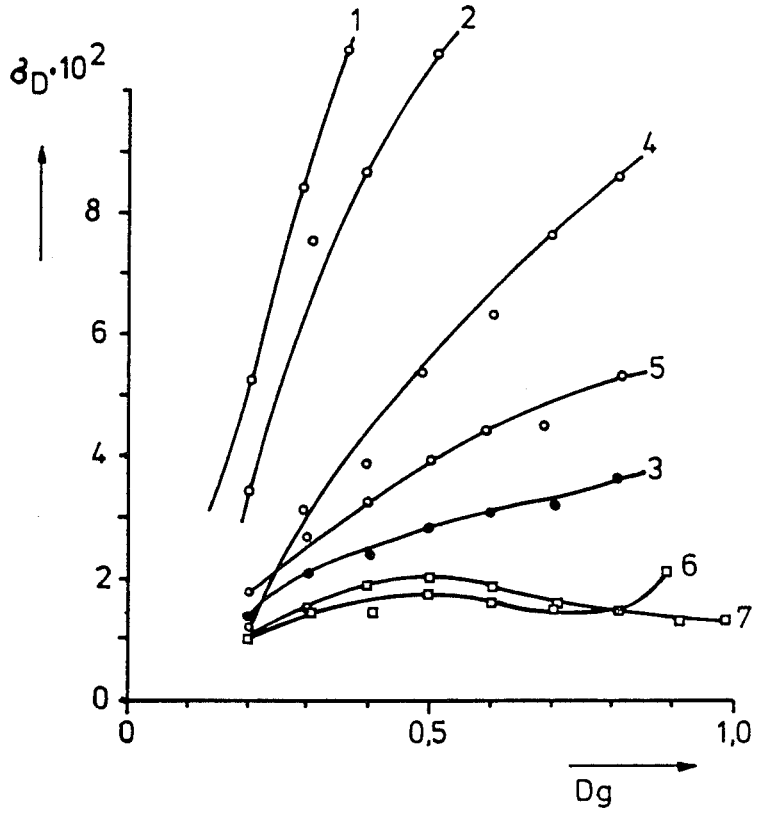
$\delta_D \cdot 10^2$
8
6
4
2
0
0
0,5
1,0
Dg
1
2
3
4
5
6
7

PHOTOGRAPHIC RECORDING MATERIAL

This application is a continuation of application Ser. No. 115,115, filed Nov. 02, 1987, now abandoned.

This invention relates to a photographic recording material having at least one layer of binder and, contained in said layer, a dispersion of particles of a complex coacervate hardened with a special hardener. Said particles may contain light sensitive silver halide and/or any other active or useful compound. In a preferred embodiment said recording material is a colour photographic recording material and said particles contain light-sensitive silver halide and a colour providing substance.

The use of so-called packet emulsions in photography has long been known, especially in colour photography. It has always been an aim to simplify the multilayered construction of the recording materials and thereby reduce the production costs. This has been achieved by combining several so-called packet emulsions containing silver halides of different spectral sensitivities and their spectrally associated colour providing substances in a single layer. Such a packet emulsion consists of particles ("packets") dispersed in a binder phase, in which particles a light-sensitive silver halide of a particular spectral sensitivity and the spectrally associated colour providing substance, e.g. a colour coupler or a dye releasing compound, are combined in such a manner that there is a spatial relationship between them and this relationship is preserved even when the particular packet emulsion is mixed with packet emulsions of a different spectral sensitivity to form so-called mixed packet emulsions. Mixed packet emulsions of this kind and methods for their preparation are described, for example, in US-A-2 698 794. The method given there has also been proposed for heat development process (DE-A-3 232 674, DE-A-3 510 685).

One method of producing a packet emulsion in which a colour providing substance is incorporated by complex coacervation has been described, for example, in US-A 3 276 869 and US-A-3 396 026. The preparation of microcapsules by complex coacervation has also been described, for example in "Microcapsule Processing and Technology" by Asaji Kondo, Marcel Dekker Inc., New York and Basle, 1979, pages 70 et seq.

The preparation of packet emulsions by complex coacervation is generally carried out by one of the two methods described below.

According to the first method, hydrophilic colloids, each selected from a first group and a second group of hydrophilic colloids as defined hereinafter, are mixed in suitable proportions and an aqueous solution of this mixture is prepared at a concentration of 1 to 4%. The temperature of the solution is maintained at 35° to 60° C. and the pH above 5.5. The pH is reduced by the addition of an acid to bring about coacervation.

According to the second method, the temperature (not below 35° C.) and pH (not above 5.5) are maintained under conditions at which coacervation can take place and an aqueous hydrophilic solution of mixed colloids initially at a concentration of at least 6% is diluted by the addition of warm water to a concentration suitable for coacervate formation.

Whichever method is chosen, complex coacervation is accompanied by a substantial reduction in the volume of binder and of the substances dispersed therein compared with the volume of the dilute continuous phase of the hydrophilic colloid which does not take part in the coacervation. The concentration of the coacervate should therefore be increased by separating the coacervate from the dilute, continuous phase of the colloid. This may be achieved in a known manner by filtration, decanting or centrifuging. Furthermore, the packet emulsion obtained may be atomized for complete drying, for example by means of spray drying methods of the kind used for the preparation of microcapsules.

It is also advantageous to harden the particles of the packet emulsion by means of known hardeners in order to stabilize the particles mechanically and ensure that they will be more readily dispersed.

Examples of hardeners hitherto used for the preparation of packet emulsions include chromium salts (for example, chrome alum, chromium acetate), aldehydes (for example, formaldehyde, glyoxal, glutaraldehyde), N-methylol compounds (for example, dimethylolurea, methylol dimethylhydantoin), dioxane derivatives (for example, 2,3-dihydroxydioxane), active vinyl compounds (for example, 1,3,5-triacryloylhexahydro-s-triazine, 1,3-vinylsulphonyl-2-propanol), active halogen compounds (for example, 2,4-dichloro-6-hydroxy-s-triazine) and mucohalic acids (for example, mucochloric acid, mucophenoxychloric acid). These hardeners may be used singly or as mixtures.

One critical point in the process of preparation of very fine packet emulsions (particle size below 5 μm) is the stage of concentration (e.g. centrifuging). At this stage there is generally a great risk of formation of particle agglomerates (joining together of separate packet particles to form larger particles) which cannot subsequently be rehomogenized. This risk increases with decreasing particle size and is particularly critical for particle sizes below 5 μm.

The above-mentioned hardeners hitherto used also have the disadvantage that they either have a generally very slow hardening action on gelatine (e.g. aldehydes, N-methylol compounds, etc.) or have a reduced hardening speed at the pH required for coacervation (e.g. vinyl sulphonyl compounds).

At the stage of concentration, this generally leads to the formation of large agglomerate particles due to individual packet particles sticking together. The slow progress of hardening of these agglomerates then prevents rehomogenization.

Hardening with chromium salts, which is a well known standard method, generally causes the formation of large agglomerate particles even before the stage of concentration, presumably due to a sort of flocculation effect, and thus results in a considerable loss of quality of very fine packet emulsions.

The same adverse effect on the particle size distribution is also produced by very rapidly hardening substances such as carbodiimides but the cause is in these cases none too clear.

It is an object of the present invention to provide a dispersion of hardened particles for photographic recording materials which dispersion can easily be rehomogenized after concentration.

The present invention relates to photographic recording material having at least one layer of binder and a dispersion of hardened particles of a complex coacervate contained in this layer of binder, characterized in that the particles of complex coacervate contain at least one carboxylic and amino group-containing proteinaceous polymeric binder and are hardened with a hardener corresponding to the following formula I

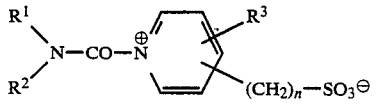

I wherein $R^1$ and $R^2$ are identical or different and each denotes an alkyl group having 1 to 8 carbon atoms or an aryl or aralkyl group optionally substituted with an alkyl group having 1 to 2 carbon atoms or with a halogen atom or $R^1$ and $R^2$ together denote the atoms required for completing a heterocyclic ring, e.g. a piperidine or morpholine ring, optionally substituted with an alkyl group having 1 to 2 carbon atoms or with a halogen atom, $R^3$ denotes a hydrogen atom or an alkyl group having 1 or 2 carbon atoms and n represents 0 or 2.

Such hardeners are described, for example, in DE-A-2 439 551. Examples of such hardeners (H-) are shown below:

H-1

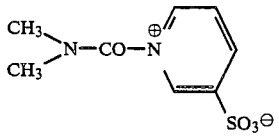

H-2

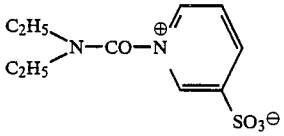

H-3

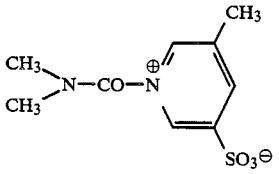

H-4

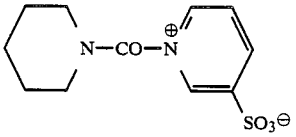

H-5

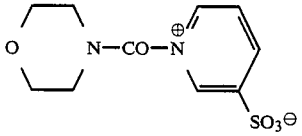

H-6

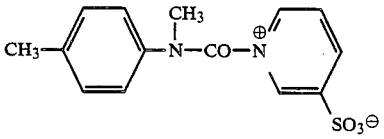

H-7

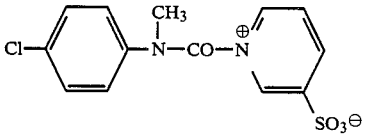

-continued

H-8

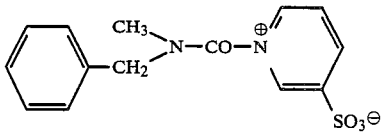

H-9

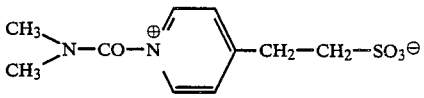

H-10

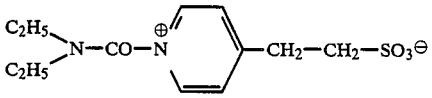

H-11

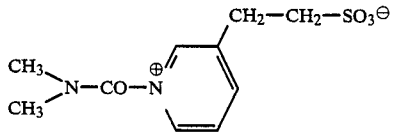

H-12

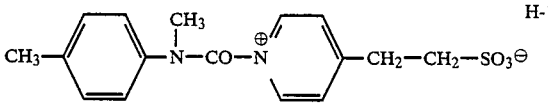

H-13

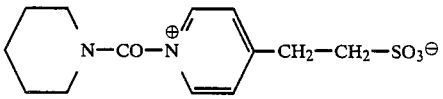

H-14

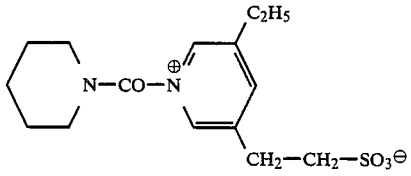

H-15

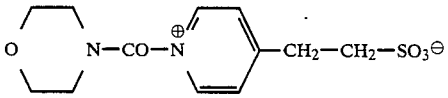

H-16

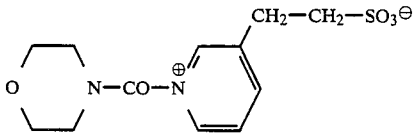

H-17

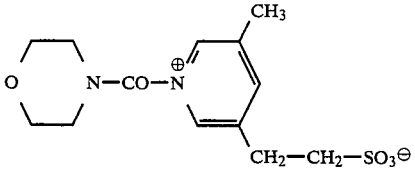

H-18

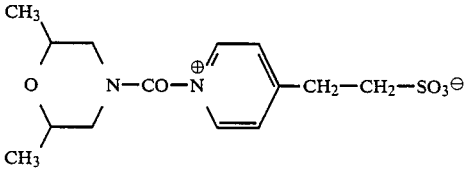

-continued

H-19

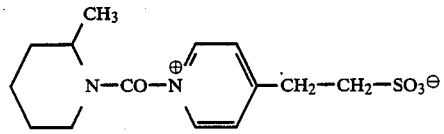

H-20

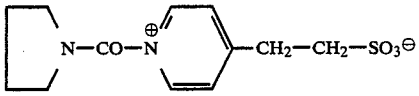

Based on the quantity of hardenable binder, the hardener is normally used in proportions in the range of from 0.05:1 to 0.2:1, preferably in proportions of about 0.1:1. The hardener is preferably used in the form of an aqueous solution, e.g. a 1 to 5%, preferably a 2% solution. The hardener is preferably added during or after the stage of coacervation and before concentration.

The hydrophilic colloids which may be used for complex coacervation may be divided into two groups. The first group covers compounds containing at least one nitrogen atom; an aqueous solution of such a colloid has a negative charge at a pH above its isoelectric point and a positive charge at a pH below its isoelectric point (i.e. a cationic compound or a cationic polymer). Examples of these compounds include carboxylic and amino group-containing proteinaceous polymeric binders such as gelatine, casein, albumin. The second group covers compounds whose aqueous solutions always carry a nagative charge, regardless of the pH (i.e. anionic compounds). Examples of such compounds include natural colloids such as sodium alginate, gum arabic, agar agar, pectin, konjak, synthetic polymers containing acid groups or alkali metal salts thereof, such as copolymers of vinyl methyl ether or ethylene and maleic acid anhydride, carboxymethylcellulose, polyvinyl sulphonic acid or condensation products of naphthalene sulphonic acid and formalin. Preferred examples of anionic polymers suitable for the purpose of this invention include compounds with recurrent units containing carboxylate and/or sulphonate groups and having molecular weights not below 1000, preferably not below 3000. Among the compounds belonging to these two groups, gelatine, agar agar and sodium alginate can be gelled by cooling. Gelatine is particularly suitable for the preparation of packet emulsions as it can be gelled by cooling and is easily hardened by a hardener.

Complex coacervation is therefore preferably carried out with a combination of gelatine and an anionic polymer. The quantity of colloidal substances used varies according to the charge density of the substances at the time of coacervate formation by the colloid of one group is generally used in a quantity amounting to 1/20 to 20 times the weight of the colloid of the other group. The two types of colloid are preferably used in proportions by weight of from 0.5:1 to 4:1 and may consist, for example, of a combination of gelatine and gum arabic.

The following four conditions are necessary for complex coacervation:

First, the concentration of hydrophilic colloid both in the first group and in the second group must lie in the range of from 0.5 to 6%, preferably from 1 to 4%.

Secondly, the pH must not be higher than 5.5. The size of the packet emulsion particles varies considerably according to the pH but also depends on the degree of mixing. The optimum pH varies according to the nature of the colloid but is in most cases in the range of from 5.2 to 4.0, preferably from 5.0 to 4.5. The size of the packet emulsion particles is generally in the range of from 1 to 100 μm, preferably from 2 to 60 μm and most preferably from 5 to 30 μm.

Thirdly, the temperature of the system must be higher than the solidification point of the aqueous colloid solution. In the case of gelatine, the temperature must not be below 35° C. and is preferably in the region of 40° to 55° C.

Fourthly, the quantity of coexisting inorganic salts must not exceed a certain critical value which is characteristic of the type of salt.

The complex coacervates are subsequently hardened with a hardener corresponding to the general formula I. The complex coacervate obtained remains completely rehomogenizable when hardened with the hardener according to the invention and has particles with a comparatively narrow particle size distribution and an average particle size (diameter) in the range of from 0.5 to 20 μm, preferably from 2 to 10 μm.

The complex coacervates according to the invention enable a wide variety of photographic additives, such as light-sensitive substances or colour providing substances as well as other photographically active or useful compounds such as developer substances, antioxidants, UV-absorbers and light-protecting agents, stabilizers, development inhibitors, development accelerators as well as precursors thereof, used either singly or in any combination to be dispersed in photographic binder layers. These substances are present during formation of the complex coacervate so that they are incorporated together with the binder in the particles of the complex coacervate or the packet emulsion. The photographic additives used may be solid substances or compounds present in a molten or dissolved state. It is also possible to prepare complex coacervates containing both light-sensitive silver halide, optionally in combination with a substantially light-insensitive organic silver salt, and a colour providing substance such as a colour coupler or a dye releasing compound or a dye which can be bleached out.

The use of packet emulsions according to the invention enables several emulsion components differing in their spectral sensitivity, including the spectrally associated colour forming substances, to be combined in a single layer of binder without loss of the spectral association and therefore without falseification of the colour. This is possible because the amount of dye formed from the colour providing substance which is present in the same coacervate particle (packet) as a silver halide particle is determined almost entirely by the amount of exposure of the given silver halide particle. The use of packet emulsions therefore enables a blue-sensitive, a green-sensitive and a red-sensitive silver halide emulsion and their spectrally associated colour providing substances to be all accommodated in the same layer of binder without risk of serious colour falsification.

The substances contained in the hardened particles of the complex coacervate may be silver halides composed of silver chloride, silver bromide, silver iodide or mixtures thereof and may have a particle size of from 0.02 to 2.0 μm, preferably from 0.1 to 1.0 μm. The silver halide may be non-sensitized or it may be chemically and/or spectrally sensitized by suitable additives. The quantity of light-sensitive silver halide in each layer may be from 0.01 to 5.0 g per $m^2$ or more. For emulsion systems consisting of a mixture of silver halides and organic silver salts, the quantity of silver halide lies mainly in the upper region, preferably amounting to 0.25 to 1.0 g/m$^2$ for each emulsion component.

If the particles contain a substantially light-insensitive silver salt, this may consist e.g. of a silver salt which is comparatively stable to light, such as an organic silver salt. Suitable examples of such salts include the silver salts of aliphatic and aromatic carboxylic acids and he silver salts of nitrogen-containing heterocyclic compounds as well as silver salts of organic mercapto compounds.

The following are examples of preferred silver salts of aliphatic carboxylic acids: Silver behenate, silver stearate, silver oleate, silver laurate, silver caprate, silver myristate, silver palmitate, silver maleate, silver fumarate, silver tartrate, silver furoate, silver linolate, silver adipate, silver sebacate, silver succinate, silver acetate and silver butyrate. The carboxylic acids of these silver salts may be substituted, for example with halogen atoms, hydroxyl groups or thioether groups.

Examples of silver salts of aromatic carboxylic acids and other compounds containing carboxyl groups include silver benzoate, silver 3,5-dihydroxybenzoate, silver o-methylbenzoate, silver m-methylbenzoate, silver p-methylbenzoate, silver 2,4-dichlorobenzoate, silver acetamido benzoate, silver gallate, silver tannate, silver phthalate, silver terephthalate, silver salicylate, silver phenyl acetate, silver pyromellitate and silver salts of 3-carboxymethyl-4-methyl-4-thiazoline-2-thione and similar heterocyclic compounds. Silver salts of organic mercaptans are also suitable, e.g. the silver salts of 3-mercapto-4-phenyl-1,2,4-thiazole, 2-mercaptobenzimidazole, 2-mercapto-5-aminothiadiazole, 2-mercaptobenzothiazole, 2-mercaptobenzoxazole, 2-mercaptooxadiazole, mercaptotriazine and thioglycollic acid and the silver salts of dithiocarboxylic acids, e.g. the silver salt of dithioacetate.

Silver salts of compounds containing an imino group are also suitable. Preferred examples of these include the silver salts of benzotriazole and its derivatives, e.g. the silver salts of alkyl substituted and/or halogen substituted benzotriazoles, such as the silver salts of methylbenzotriazole and of 5-chlorobenzotriazole as well as the silver salts of 1,2,4-triazole, 1-H-tetrazole, carbazole and saccharine and the silver salts of imidazole and derivatives thereof.

The quantity of substantially light-insensitive silver salt present in any particular layer according to the invention is from 0.05 to 5 g/m$^2$ of the layer. The substantially light-insensitive silver salt and the light-sensitive silver salt may be present side by side as separate particles in th coacervate particles or they may be present in a combined form which may be obtained, for example, by treating a substantially light-insensitive silver salt in the presence of halide ions so that light-sensitive centres of light-sensitive silver halide are formed on the surface of the particles of substantially light-insensitive silver salt by a process of double conversion; see US-A-3 457 075.

The substantially light-insensitive silver salt may constitute a reservoir of metal ions which are reduced to elementary silver under the catalytic influence of the imagewise exposed silver halide if heat development is carried out in the presence of a reducing agent and thus serve as oxidizing agent (for the reducing agent present).

Other possible constituents in the coacervate particles include colour providing substances such as colour complers which give rise to a more or less diffusion resistant dye in the process of development, or dye releasing compounds which release a diffusible dye as a result of development. The coacervate particles of a given packet emulsion may contain one colour coupler or several colour couplers; in the latter case, they are preferably couplers which give rise to approximately the same colour on colour development.

Colour couplers for the production of the cyan partial colour image are generally couplers of the phenol or α-naphthol series; suitable examples of these are described in EP-A-0 028 099, EP-A-0 067 689, EP-A-0 175 573 and EP-A-0 184 057.

Colour couplers for production of the magenta partial colour image are generally couplers of the 5-pyrazolone, the indazolone or the pyrazoloazole series; suitable examples are described in DE-A-1 547 803, DE-A-2 408 665, GB-A-1 247 493 and EP-A-0 174 804.

Colour couplers for production of the yellow partial colour image are generally couplers containing an open chain ketomethylene group, in particular couplers of the α-acylacetamide series. Suitable examples of these include the α-benzoylacetanilide couplers are α-pivaloylacetanilide couplers described in US-A-3 265 506 and DE-A-2 456 076.

The colour couplers may be either 4-equivalent couplers or 2-equivalent couplers. The latter are well known to be derived from 4-equivalent couplers in that they contain in their coupling position a substituent which is split off in the coupling reaction. The 2-equivalent couplers include both couplers which are virtually colourless and couplers which have an intense colour of their own which disappears in the colour coupling reaction and may be replaced by the colour of the image dye produced (masking couplers). The 2-equivalent couplers in principle also include those known white couplers which give rise to substantially colourless products when they react with colour developer oxidation products. Also to be included among the 2-equivalent couplers are those couplers which carry in their coupling position a releasable group which is released in the reaction with colour developer oxidation products to produce a particular photographic effect, e.g. as development inhibitor or accelerator. The photographic effect may be produced either directly by the released group or after the release of one or more further groups from the group originally released (e.g. DE-A-2 703 145, DE-A-2 855 697, DE-A-3 105 026 and DE-A-3 319 428). Examples of such 2-equivalent couplers include the known DIR couplers and DAR and FAR couplers.

Suitable DIR couplers are described, for example, on GB-A-953 454, DE-A-1 800 420, DE-A-2 015 867, DE-A-2 414 006, DE-A-2 842 063 and DE-A-3 427 235.

Suitable DAR and FAR couplers are described, for example, in DE-A-3 209 110, EP-A-0 089 834, EP-A-0 117 511 and EP-A-0 118 087.

Since the DIR, DAR and FAR couplers are required mainly for the action of the group released by the coupling reaction and less for their colour forming properties, DIR, DAR and FAR couplers which give rise to virtually colourless products in the coupling reaction are also suitable, for example as described in DE-A-1 547 640.

The releasable group may be a ballast group so that the reaction with colour developer oxidation products may give rise to coupling products, e.g. dyes, which are diffusible or at least have a slight if limited mobility, for example as described in US-A-4 420 556.

High molecular weight colour couplers are described, for example, in DE-C-1 297 417, DE-A-2 407 569, DE-A-3 148 125, DE-A-3 217 200, DE-A-3 320 079, DE-A-3 324 932, DE-A-3 331 743, DE-A-3 340 376, EP-A-27 284 and US-A-4 080 211. The high molecular weight colour couplers are generally prepared by the polymerisation of ethylenically unsaturated monomeric colour couplers but they may also be obtained by polyaddition or polycondensation.

If the colour providing substance present in the coacervate particles is a dye releasing compound, it may be any of numerous types of compounds which are all distinguished by the presence of a linking member which is redox dependent in the strength of its bond and which links a dye residue to a carrier residue containing a ballast residue.

See in this connection a summarizing account of this field in Angew. Chem. Int. Ed. Engl. 22 (1983), 191–209, in which the most important of the known systems are described.

Particularly advantageous dye releasing compounds of this kind are the redox active dye releasing compounds of the formula

BALLAST-REDOX-DYE in which

BALLAST denotes a ballast residue,

REDOX denotes a redox active group, i.e. a group which is oxidizable or reducible under the conditions of alkaline development and which, depending on whether it is present in its oxidized or in its reduced state, is capable of undergoing to varying degrees an elimination reaction, a nucleophilic displacement reaction, hydrolysis or some other decomposition reaction which results in the release of the DYE residue and DYE denotes the residue of a diffusible dye, e.g. a yellow, magenta or cyan dye, or the residue of a dye precursor.

The ballast residues are any residues capable of incorporating the dye releasing compounds according to the invention in a diffusion-fast form in the hydrophilic colloids normally used in photographic materials. Particularly suitable for this purpose are organic residues generally containing straight chained or branched aliphatic groups with generally 8 to 20 carbon atoms and optionally also containing carbocyclic or heterocyclic, optionally aromatic groups. These residues are attached either directly or indirectly to the remainder of the molecule, e.g. through one of the following groups: NHCO, $NHSO_2$, NR (R=hydrogen or alkyl), O or S. The ballast residue may in addition contain water-solubilizing groups, e.g. sulpho groups or carboxyl groups, which may be present in an anionic form. Since the diffusion properties depend on the molecular size of the whole compound, it is sometimes sufficient to use shorter chained groups as ballast residues, e.g. if the molecule as a whole is large enough.

Redox-active carrier residues having the structure BALLAST-REDOX- and suitable dye releasing compound are known in various forms. A detailed account of these may be omitted here in view of the above-mentioned article in Angew. Chem. Int. Ed. Engl. 22 (1983) 191–209.

Some examples of redox-active carrier residues from which a dye residue is split off after imagewise oxidation or reduction are shown below purely for illustration:

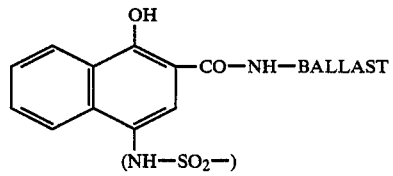

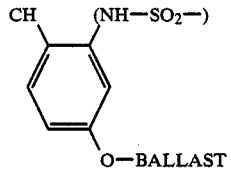

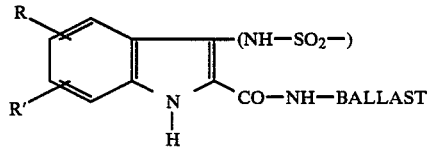

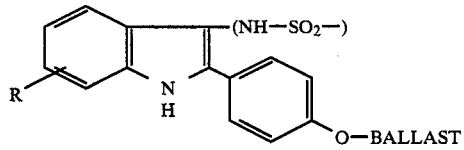

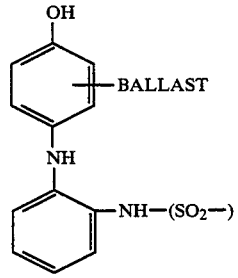

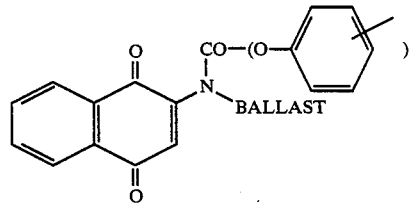

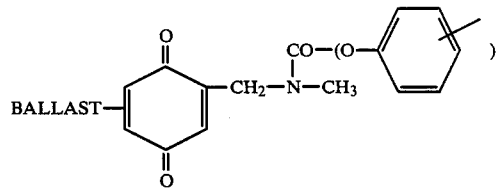

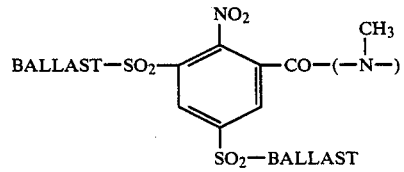

-continued

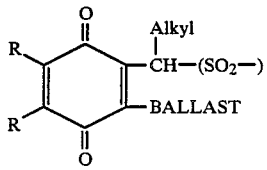

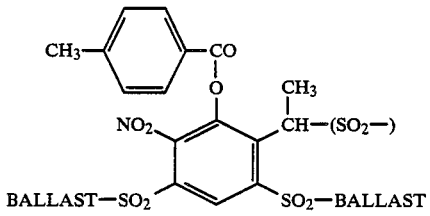

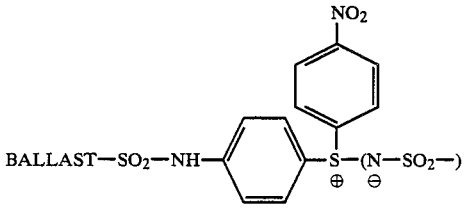

The groups shown in brackets are functional groups of the dye residue and are separated from the remainder of the carrier residue together with the dye residue. The functional group may consist of a substituent which has a direct influence on the absorption properties and possibly also the complex forming properties of the released dye. The functional group may be separated from the chromophore of the dye by an intermediate or linking member. Furthermore, the functional group may be of importance in conjunction with the intermediate member in determining the diffusion and mordanting properties of the released dye. Suitable intermediate members include, for example, alkylene groups and aryl groups.

The dye residues may in principle be residues from any classes of dyes, provided they are sufficiently diffusible to diffuse into an image receptor layer from the light-sensitive layer of the light-sensitive material. The dye residues may be provided for this purpose with one or more groups which render them soluble in alkalies. Such alkali solubilizing groups include inter alia carboxyl groups, sulpho groups, sulphonamide groups and aromatic hydroxyl groups. These alkali solubilizing groups may be present from the start in the dye releasing compounds used according to the invention or they may result from the release of the dye residue from the carrier residue containing the ballast groups. The following are dyes which are particularly suitable for the process according to the invention: Azo dyes, azomethine dyes, anthraquinone dyes, phthalocyanine dyes, indigoid dyes and triphenylmethane dyes, including dyes which form or are capable of forming complexes with metal ions.

The residues of dye precursors are residues of compounds which are converted into dyes in the course of the photographic process, either by oxidation or by coupling or by complex formation or by release of an auxochromic group in a chromophoric system, for example by saponification, in particular under the conditions of heat development. Dye precursors in this sense include leuco dyes, couplers and dyes which are converted into other dyes in the course of processing. In cases where it is not necessary to distinguish between dye residues and residues of dye precursors, the latter residues will also be referred to hereinafter as dye residues.

Suitable dye releasing compounds have been described, for example, in the following: US-A-3 227 550, US-A-3 443 939, US-A-3 443 940, DE-A-1 930 215, DE-A-2 242 762, DE-A-2 402 900, DE-A-2 406 664, DE-A-2 505 248, DE-A-2 543 902, DE-A-2 613 005, DE-A-2 645 656, DE-A-2 809 716, DE-A-2 823 159, BE-A-861 241, EP-A-0 004 399, EP-A-0 004 400, DE-A-3 008 588, DE-A-3 014 669 and GB-A-8 012 242.

In some embodiments of the recording material according to the invention, the dye releasing compounds may be present in an oxidizable form or capable of coupling whereas in others they may be present as reducible dye releasing compounds. When conventional negatively functioning silver halide emulsions are used, the copy obtained from the original is either a negative or a positive, depending on whether the dye has been released from the oxidized or the reduced form of dye releasing compound. It is therefore possible to obtain either positive or negative images as desired by suitable choice of the dye releasing system. Particularly suitable oxidizable dye releasing compounds are described, for example, in DE-A-2 645 656.

If the dye releasing compound is oxidizable, it is itself a reducing agent which is oxidized by the imagewise exposed silver halide, either directly or indirectly by means of electron transfer agents ETA. This results in an imagewise differentiation in the capacity to release the diffusible dye. If, on the other hand, the dye releasing compound is reducible, then it is preferably used in combination with a limited quantity of reducing agent present, a so-called electron donor compound or electron donor precursor compound, which in that case is present side by side with the dye releasing compound in the coacervate particles of one and the same packet emulsion. The action of the electron transfer agent may also be advantageous when reducible dye releasing compounds are used in combination with electron donor compounds.

For the production of positive colour images from positive originals by means of negatively operating silver halide emulsions it is suitable to use, for example, a recording material containing a packet emulsion in which reducible dye releasing compounds of the following formula are present in combination with an electron donor compound:

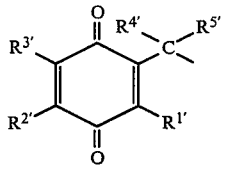

"Carquin"

In the above formula, $R^{1'}$ denotes alkyl or aryl, $R^{2'}$ denotes alkyl, aryl or a group which together with $R^{3'}$ completes a condensed ring, $R^{3'}$ denotes hydrogen, alkyl, aryl, hydroxyl, halogen such as chlorine or bromine, amino, alkylamino and dialkylamino including cyclic amino groups (such as piperidino, morpholino), acylamino, alkylthio, alkoxy, aroxy, sulpho or a group which together with $R^{2'}$ completes a condensed ring, $R^{4'}$ denotes alkyl and $R^{5'}$ denotes alkyl or, preferably, hydrogen, and at least one of the groups $R^{1'}$ to $R^{4'}$ contains a ballast residue.

The electron donor compound used in combination with a reducible dye releasing compound serves as reducing agent both for the silver halide and for the dye releasing compound. Since the silver halide and the dye releasing compound compete with each other for the oxidation of the electron donor compound but the silver halide is superior to the dye releasing compound in this respect, the silver halide present determines, according to the extent of its previous imagewise exposure, the areas of the image within which the dye releasing compound is converted into its reduced form by the electron donor compound.

Under the conditions of development, e.g. when the imagewise exposed colour photographic material is heated, the electron donor compound which is present in a limited quantity is oxidized according to the extent of exposure which has taken place and it is then no longer available for a reaction with the dye releasing compound. An imagewise distribution of unused electron donor compound is therefore formed.

Compounds which have been described as electron donor compounds include, for example, non-diffusible or only slightly diffusible derivatives of hydroquinone, of benzisoxazolone, of p-aminophenol or of ascorbic acid (e.g. ascorbyl palmitate) (DE-A-2 809 716).

Further examples of electron donor compounds are given in DE-A-2 947 425, DE-A-3 006 268, DE-A-3 130 842, DE-A-3 144 037, DE-A-3 217 877, EP-A-0 124 915 and in Research Disclosure No. 24 305 (July 1984). It has been shown that the electron donor compounds mentioned are also suitable for recording materials which are developable by heat. Particularly suitable are those electron donor compounds which are present in a virtually inactive, masked form in the recording material before development and only released from this inactive form under the conditions of development in the layer. These initially inactive electron donor compounds are converted into their active form under the conditions of development, for example by the hydrolytic removal of certain protective groups.

The employment of packet emulsions which have been hardened according to the invention enables a silver halide emulsion of a particular spectral sensitivity and colour forming substances used for the production of a particular partial colour image, preferably the partial colour image which is complementary in colour to this spectral sensitivity, to be spatially and spectrally associated with one another in one and the same packet emulsion and this association can be preserved even when this packet emulsion is mixed with other packet emulsions of a different spectral sensitivity to form a mixed packet emulsion.

By "spatial association" is meant that the colour forming substance is in such spatial relationship to the silver halide particles that it is capable of interaction with the particles so that an imagewise correspondence can be obtained between the silver image formed in the process of development and the colour image produced from the colour forming substance. According to the invention, this is achieved by virtue of the colour forming substances and the silver halide particles being present side by side in the same coacervate particles.

By "spectral association" is meant that the spectral sensitivity of each of the different packet emulsions and the colour of the partial colour image produced from the spatially associated colour coupler stand in a certain relationship to one another, each spectral sensitivity (red, green, blue) being associated with a different colour of the particular partial colour image (e.g. cyan, magenta, yellow).

In addition to the constituents already mentioned, the photographic recording material according to the invention may contain further constituents and auxiliary substances. These additional components are preferably present in the common binder phase of the light-sensitive layer or in one of the other layers but they may equally well form part of a complex coacervate which has been hardened according to the invention, and as such they may be present either alone or in combination with silver halides, colour forming substances and/or other auxiliary substances.

The possible auxiliary substances include, for example, auxiliary developers. These generally have the property of developing exposed silver halide. In the present case they act mainly to promote the reactions between the exposed silver salt (=silver salt in the presence of exposed silver halide) and the reducing agent which is identical with the dye releasing compound if the latter is oxidizable but reacts with the dye releasing compound if the latter is reducible. As these reactions consist mainly in a transfer of electrons, the auxiliary developers are also known as electron transfer agents ETA.

Examples of suitable auxiliary developers include hydroquinone, pyrocatechol, pyrogallol, hydroxylamine, ascorbic acid, 1-phenyl-3-pyrazolidone and derivatives thereof. Since these auxiliary developers exert a catalytic function, they need not be present in stoichiometric quantities. It is generally sufficient to use them in quantities of up to ½ mol per mol of dye releasing compound present in the layer. They may be incorporated in the layer by, for example, adding them from solutions in aqueous solvents or they may be added in the form of aqueous dispersions obtained with the aid of oil formers.

The auxiliary substances also include, for example, basic substances or compounds which are capable of providing basic substances as a result of the heat treatment. Examples include sodium hydroxide, potassium hydroxide, calcium hydroxide, sodium carbonate, sodium acetate and organic bases, in particular amines such as trialkylamines, hydroxyalkylamines, piperidine, morpholine, dialkylaniline, p-toluidine, 2-picoline, guanidine and salts thereof, in particular salts with aliphatic carboxylic acids. These basic substances provide a suitable medium in the light-sensitive layer and adjacent layers during the heat treatment to ensure the release of the diffusible dyes from the dye releasing compounds and their diffusion into the image receptor layer.

The auxiliary substances may also include compounds which are capable of releasing water under the action of heat. These include in particular inorganic salts containing water of crystallization, e.g. $Na_2SO_4.10H_2O$ and $NH_4Fe(SO_4)_2.12H_2O$.

The water released on heating promotes the development and diffusion processes required for production of the image.

Further auxiliary substances include, for example, the so-called thermal solvents which are generally nonhydrolysable organic compounds which are solid under normal conditions but melt when heated to the temperature of the heat treatment to provide a liquid medium in which the processes of development take place more rapidly. These thermal solvents may, for example, act as diffusion accelerators. Preferred examples of thermal solvents include polyglycols such as those described, for example, in US-A-3 347 675, e.g. polyethylene glycols having an average molecular weight of from 1500 to 20,000, derivatives of polyethylene oxide such as oleic acid esters, beeswax, monostearin, compounds containing $SO_2$ or CO and having a high dielectric constant, e.g. acetamide, succinamide, ethyl carbamate, urea, methylsulphonamide or ethylene carbonate; also polar substances as described in US-A-3 667 959, the lactone of 4-hydroxybutanoic acid or of 4-hydroxybutyric acid, dimethylsulphoxide, tetrahydrothiophene-1,1-dioxide, 1,10-decanediol, methyl anisate and biphenyl suberate, etc. as described in Research Disclosure, pages 26 to 28 (December 1976), etc.

For the preparation of photographic recording material, the packet emulsion which has been hardened according to the invention may be dispersed in an aqueous solution of a proteinaceous binder and cast to form a layer. The binder of the layer may be conventionally hardened with any hardener such as formaldehyde or a bisfunctional aldehyde compound, ethylene imine compound or vinyl sulphonyl compound or with a hardener which activates carboxyl groups; for example, a compound corresponding to formula I.

Development of an imagewise exposed colour photographic recording material according to the invention on the basis of chromogenic coupling with diffusion resistant colour couplers may be carried out, for example, by conventional wet processes using colour developer baths and bleaching and fixing baths or bleach fixing baths. Dye diffusion materials may be developed by means of activator pastes or activator baths as known from conventional dye diffusion photography.

For colour photographic recording materials which are developable by heat, the development process covers the stages of silver halide development, release of an imagewise distribution of diffusible dyes and transfer of this imagewise distribution to an image receptor layer by diffusion. This process of development is initiated by subjecting the exposed recording material to a heat treatment in which the light-sensitive layer of binder is heated to a temperature in the region of 80° to 250° C. for a period of about 0.5 to 800 seconds. This heat treatment produces suitable conditions for the development processes in the recording material, including the process of dye diffusion, without the supply of a liquid medium, e.g. in the form of a developer bath. In this process of development, diffusible dyes are released imagewise from the dye releasing compounds and transferred to an image receptor layer which may be an integral part of the colour photographic recording material according to the invention or is at least in contact with this material during the time of development. Imagewise development of silver, release of dye and transfer of colour thus take place synchronously in a one-step development process.

Production of the colour image in the colour photographic recording material according to the invention may also be carried out by a two-stage development process in which silver halide development and release of dye take place in a first stage which is followed by the second stage consisting of transfer of the colour image from the light-sensitive part to an image receptor part in contact therewith, e.g. by heating to a temperature in the region of 50° to 150° C., preferably 70° to 90° C., in which case diffusion auxiliaries (solvents) may be applied externally before the light-sensitive part is laminated to the image receptor part.

The image receptor layer may thus be arranged on the same layer support as the light-sensitive element (single sheet material) or on a separate layer support (two-sheet material). The image receptor layer consists substantially of a binder containing mordant for fixing the diffusible dyes released from the non-diffusible dye releasing compounds. The mordants used for anionic dyes are preferably long chained quaternary ammonium or phosphonium compounds, e.g. those described in US-A-3 271 147 and US-A-3 271 148.

Certain metal salts and their hydroxides which form difficultly soluble compounds with the acid dyes may also be used; further, polymeric mordants such as those described in DE-A-2 315 304, DE-A-2 631 521 or DE-A-2 941 818. The dye mordants are dispersed in a conventional hydrophilic binder in the mordant layer, e.g. in gelatine, polyvinyl pyrrolidone or partially or completely hydrolysed cellulose esters. Some binders may, of course, function as mordants, e.g. the polymers of nitrogen-containing, optionally quaternary bases such as N-methyl-4-vinyl pyridine, 4-vinylpyridine or 1-vinylimidazole, as described, for example, in US-A-2 484 430. Other examples of suitable mordanting binders include, for example, guanyl hydrazone derivatives of alkyl vinyl ketone polymers as described, for example, in US-A-2 882 156 and guanyl hydrazone derivatives of acyl styrene polymers as described, for example, in DE-A-2 009 498. The last mentioned binders, however, would generally be used in combination with other binders, e.g. gelatine.

If the image receptor layer remains in contact with the light-sensitive element after development, an alkali permeable, light-reflecting layer of binder containing pigment is generally provided between them to serve as optical separation between the negative and the positive and as aesthetically pleasing image background for the transferred positive colour image. The yellow filter layer used according to the present invention is in that case situated on that side of the light-sensitive layer which is opposite to the light-reflecting layer of binder containing pigment. If the image receptor layer is placed between the layer support and the light-sensitive element and is separated from the latter by a preformed light-reflecting layer, the layer support must either be transparent so that the colour transfer image produced can be viewed through the layer support or the light-sensitive element and the light-reflecting layer must both be removed from the image receptor layer to expose the latter. On the other hand, the image receptor layer may be placed as uppermost layer in an integral colour photographic recording material, in which case exposure is preferably carried out through a transparent layer support.

EXAMPLE

(a) Silver halide emulsion

The silver halide emulsion used contained silver chlorobromide (20 mol-% chloride, average particle diameter 0.36 μm) in an amount corresponding to 98.3 g of $AgNO_3$ per kg and 98.3 g of gelatine per kg. The emulsion was spectrally sensitized with the oxacarbocyanine dyes of the two following formulae, each used in an amount corresponding to 0.7 mg per 1 g of $AgNO_3$:

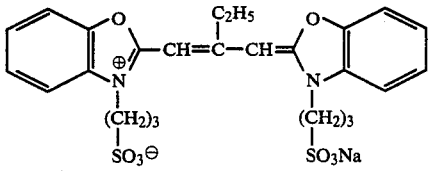

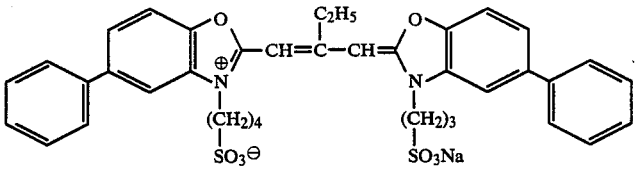

(b) Coupler dispersion 62.9 g of 1-(2,4,6-trichlorophenyl)-3-(2-chloro-5-tetradecanoyl-amidoanilino)-5-pyrazolone were dissolved in 62.9 g of tricresylphosphate and 150 ml of ethyl acetate and dispersed in a solution of 27.6 g of gelatine and 1.7 g of phenol in 500 ml of water in the presence of 2 g of wetting agent (Erkantol®20). The auxiliary solvent was then removed with depressurized steam. Yield: 740 g.

(c) General method of preparation of the test packet emulsions 88.90 g of the silver halide emulsion described under (a) are melted in 120 g of water at 40° C. 74.0 g of the coupler dispersion described under (b) are then added and melted. The liquid is then diluted with 100 ml of water and a solution of 2.3 g of gum arabic in 112.7 g of water is slowly added and the mixture is again diluted with 100 ml of water. The pH should then be between 5.0 and 5.1 and not below 5.0. It is now necessary to change over from slow stirring with a magnetic stirrer to high speed stirring (with blade stirrer at a rate of at least 2000 revs/min or mixing siren (homogenizer)). A microscopic sample must not show any sign of coacervation!

At 40° C., the mixture is now slowly adjusted to pH 4.4 to 4.5 with 1% acetic acid and the progress of coacervation is followed by checking microscopic samples (control).

The mixture is then cooled to 8° to 10° C. with continued stirring.

This procedure is followed by (1) hardening and (2) centrifuging and conditioning.

(d) Packet emulsions

Packet emulsion A: (not according to the invention, comparison)

Method of preparation as under (c) with the following additional treatment:

After cooling to 8° to 10° C., 2.20 g of chrome alum dissolved in 640 ml of water were added dropwise within 10 minutes and stirring was then continued for one hour (2000 revs/min). The mixture was concentrated by centrifuging, washed once with 400 ml of water and again centrifuged. The fresh centrifugate (230 g) was conditioned to 300 g with 10 g of 20% gelatine, 4 ml of Triton®×100 (4% aqueous solution) and 56 g of water and briefly homogenized.

Packet emulsion B: (not according to the invention, comparison)

Method of preparation as for Packet emulsion A but after the addition of chrome alum and one hour's stirring (hardening time), 11.5 ml of a 10% aqueous solution of Compound H-15 diluted with 60 ml of water were added dropwise in the course of 2 minutes and the product was then stirred for one hour. Subsequent method of procedure as for Packet emulsion A. Centrifugate: 185 g, conditioned: 300 g.

Packet emulsion C: (according to the invention)

Method of preparation as under (c) with the following subsequent treatment:

After cooling of the product to 8° to 10° C., 11.5 ml of a 10% aqueous solution of Compound H-15 diluted in 100 ml of water were added dropwise in the course of 4 to 5 minutes and the product was then stirred for one hour. Subsequent procedure as for Packet emulsion B.

The fresh centrifugate (105 g) was conditioned to a final weight of 200 g with 10 g of 20% gelatine, 4 ml of 4% aqueous Triton®×100 solution and 81 ml of water and homogenized.

Packet emulsion D: (not according to the invention, comparison

Method of preparation as under (c) with the following further treatment:

After cooling of the product to 8°–10° C., 200 mg of bis-vinylsulphonylmethane used as hardener dissolved in 20 ml of a water/acetone mixture (50:50) and diluted with 80 ml of water were added dropwise in the course of 4 to 5 minutes and the product was then stirred for one hour. Subsequent procedure as for Packet emulsion C.

The fresh centrifugate (147 g) was conditioned to 200 g with 10 g of 20% gelatine, 4 ml of 4% aqueous Triton®×100 solution and 39 g of water and briefly homogenized.

Packet emulsion E: (not according to the invention, comparison)

Preparation as indicated under (c) with the following further treatment:

After cooling of the product to 8°–10° C., 500 mg of the hardener corresponding to the following formula

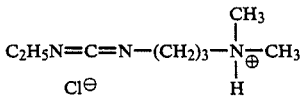

dissolved in 20 ml of a water/acetone mixture (50:50) and diluted with 80 ml of water were added dropwise in the course of 4–5 minutes and the mixture was then stirred for one hour. Subsequent procedure as for Packet emulsion D. The fresh centrifugate (168 g) was conditioned to 200 g with 10 g of 20% gelatine, 4 ml of Triton ®×100 solution and 18 g of water and briefly homogenized.

(e) Photographic recording material containing packet emulsions (general method of preparation)

6 ml of Triton ®×100 (4% aqueous solution) and 21.5 g of 20% gelatine are added to a given quantity of the packet emulsion at 40° C. and water is added to make up the final weight to 320 g. The resulting casting solution is applied to a transparent layer support of polyethylene terephthalate to form a layer having a thickness of 50 μm when wet and the layer is dried. This layer is covered with a layer of 3% gelatine having a wet thickness of 30 μm which in turn is covered with a hardening layer (1% gelatine solution) containing a hardener and applied to form a wet layer 60 μm in thickness. After hardening and drying, the following Samples 1 to 5 are obtained from Packet emulsions A to E:

Sample P1: From 110.7 g of Packet emulsion A and 181 g of water

Sample P2: From 110.7 g of Packet emulsion B and 181 g of water

Sample P3: From 73.8 g of Packet emulsion C and 218.7 g of water

Sample P4: As for Sample P3 but using 73.8 g of Packet emulsion D,

Sample P5: As for Sample P3 but using 73.8 g of Packet emulsion E.

(f) Comparison materials (without packet emulsions)

Sample P6: 32.8 g of the silver halide emulsion described under (a) were melted at 40° C. and 8 ml of a 4% aqueous solution of Triton ®×100 were added. 27.3 g of the coupler dispersion described under (b) were then added and melted; 0.85 g of gum arabic dissolved in 41.6 g of water asnd 21.5 g of 20% gelatine were added and the weight made up to 320 g by the addition of 229.6 g of water. The resulting casting solution was applied to a polyethylene terephthalate support as indicated under (e) and covered with a top layer and hardened.

Sample P7: Preparation as for Sample P6 but using the addition of gum arabic.

(g) Exposure, processing, assessments

Samples 1 to 7 were exposed in a sensitometer (Colour temperature 2850 K.; 19,000 lx) behind a graduated wedge ($\sqrt[3]{2}$) for 1/50 seconds without a grey filter and then processed by the colour negative development process described in the British Journal of Photography, 1974, pages 597 and 598.

RMS graininess measurements were then carried out on the processed samples (see JAMES, The Theory of the Photographic Process, fourth Edition, Macmillan Publishing Co., Inc. New York, pages 619 and 620). The results are represented in FIG. 1. The packet emulsion which has been hardened according to the invention provides the most favourable RMS graininess values (Curve 3). Although the graininess values of Samples 6 and 7 which contain no packet emulsions (conventional layers) are even more favourable (see curves 6 & 7) these Samples cannot be used to produce a one-layered multicoloured recording material.

We claim:

1. Photographic recording material having at least one layer of binder and a dispersion of hardened particles of a complex coacervate contained therein, characterised in that the particles of the complex coacervate contain at least one carboxylic and amino group-containing proteinaceous polymeric binder and are hardened with a hardener corresponding to the following formula I

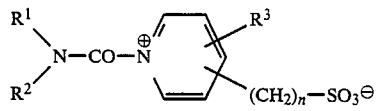

I wherein $R^1$ and $R^2$ are identical or different and each denotes an alkyl group having 1 to 8 carbon atoms or an aryl or aralkyl group optionally substituted with an alkyl group having 1 to 2 carbon atoms or with a halogen atom or $R^1$ and $R^2$ together denote the atoms required for completing a heterocyclic ring, e.g. a piperidine or morpholine ring, optionally substituted with an alkyl group having 1 to 2 carbon atoms or with a halogen atom, $R^3$ denotes a hydrogen atom or an alkyl group having 1 or 2 carbon atoms and n represents 0 or 2.

2. Recording material according to claim 1, characterised in that the particles of the complex coacervate have an average particle size in the range of from 0.5 to 20 μm.

3. Recording material according to claim 1, characterised in that the particles of the complex coacervate contain at least one photographically active or useful compound.

4. Recording material according to claim 3, characterised in that the particles of the complex coacervate contain light-sensitive silver halide and at least one colour providing substance side by side.

* * * * *